US006108952A

United States Patent [19]

Whittlef

[11] Patent Number: 6,108,952

[45] Date of Patent: Aug. 29, 2000

[54] APPARATUS FOR HOLDING GREETING CARDS

[76] Inventor: Robb W. Whittlef, 1303 Douglas Ave., Minneapolis, Minn. 55403

[21] Appl. No.: 08/824,672

[22] Filed: Mar. 26, 1997

[51] Int. Cl.[7] ..... G09F 1/10

[52] U.S. Cl. ..... 40/124; 281/48

[58] Field of Search ..... 40/124, 124.01, 40/657, 658; D19/26, 27, 32; 281/21.1, 28, 48; 211/45

[56] References Cited

U.S. PATENT DOCUMENTS

| | | | |
|---|---|---|---|
| D. 311,208 | 10/1990 | Folson . | |
| 405,026 | 6/1889 | Garton | 281/48 |
| 460,090 | 9/1891 | Fitzpatrick et al. | 281/48 |
| 678,438 | 7/1901 | Schmid | 281/48 |
| 730,727 | 6/1903 | Wolff | 281/48 |
| 1,430,335 | 9/1922 | Stengel | 281/48 |
| 4,852,280 | 8/1989 | Beattie . | |
| 5,480,036 | 1/1996 | Opar | 40/124 X |

FOREIGN PATENT DOCUMENTS

| | | | |
|---|---|---|---|
| 135148 | 11/1919 | United Kingdom | 281/48 |
| 137094 | 1/1920 | United Kingdom | 281/48 |
| 323005 | 8/1957 | United Kingdom | 281/48 |

*Primary Examiner*—Brian K. Green
*Attorney, Agent, or Firm*—Merchant & Gould P.C.

[57] ABSTRACT

An apparatus for holding, organizing, selectively displaying, and storing greeting cards is generally disclosed. The apparatus provides for securing cards within an album for storage, and yet allows the recipient of the cards to selectively review the interior and exterior portions of the various cards without physically removing the cards from the album. The apparatus includes a binder having a front cover, a rear cover and a spine. The spine includes a plurality of elongated retaining members physically oriented in a parallel, opposing manner to one another, secured to the spine, and generally parallel to the longitudinal axis of the spine. The elongated retaining members are individually inserted within the interior spine of individual cards, thereby securing the cards within the binder. This arrangement allows for the selective opening of individual cards to review the interior of the cards without removing the same from the binder. Further, the binder can be closed (e.g., the front and rear covers are moved to a position wherein the two covers generally oppose one another) which provides for secure compact storage.

6 Claims, 4 Drawing Sheets

24b
38
25
23
32
37
24a
31
35
30
34
33
36
24
33a
33b

APPARATUS FOR HOLDING GREETING CARDS

FIELD OF THE INVENTION

This invention relates generally to an apparatus for holding and displaying greeting cards, and more particularly relates to a binder for retaining greeting cards wherein the cards are organized and stored, and may also be selectively viewed without being removed from the binder.

BACKGROUND OF THE INVENTION

Many recipients of greeting cards desire to keep the cards and store them for later viewing and remembrances. Typically in the past, however, cards were placed in boxes, drawers, thrown away or misplaced because there was not an easy way to organize, secure, and properly store the cards. While there have been efforts in the prior art to develop devices to display or store cards, the prior art does not solve the problems of selectively displaying both the interior and exterior of the cards (without removing the cards from the holding device) and providing an organized compact storage container.

For example, U.S. Pat. No. 4,852,280 issued to Beattie generally discloses a device for holding cards in a manner which displays the cards. The device, however, has the drawback that it is bulky and not designed for compact storage.

Another example is U.S. Design Pat. No. 311,208 issued to Folson. This patent generally discloses a greeting card album with transparent sheets located therein for securing the cards. A drawback of the disclosed apparatus is that the sheets for securing the cards obscures the writing on the interior of the card. More specifically, the cards need to be removed from the internal sheets before the interior can be reviewed.

Accordingly, there arises a need for a simple, inexpensive apparatus for storing greeting cards and which allows the recipient of the cards to easily and selectively review the cards while still secured within the apparatus. Additionally, the apparatus should provide for compact storage of the cards. The present invention directly addresses and overcomes the shortcomings of the prior art.

SUMMARY OF THE INVENTION

The principles of this invention relate generally to an apparatus for holding and displaying greeting cards. Physical embodiments constructed in accordance with the principles of the present invention can be used by a recipient of greeting cards (e.g., such as holiday cards, birthday cards, get well cards, etc.) to hold, organize, selectively display, and store the cards. Accordingly, the present invention provides a simple, relatively inexpensive apparatus for securing cards within an album or binder for storage, and yet allows the recipient of the cards to selectively review the interior and exterior portions of the various cards without physically removing the cards from the binder.

In a preferred embodiment constructed according to the principles of the present invention, there is provided a binder having a front cover, a rear cover and a spine. The spine includes a plurality of elongated retaining members (e.g., filaments, strings, elastic strips, metal strips or rods, or other elongated retaining structures). The elongated retaining members are physically oriented in a parallel, opposing manner to one another and are oriented generally parallel to the longitudinal axis of the spine. Means are provided for securing the elongated retaining members to the spine. The elongated retaining members are individually inserted within the interior spine of individual cards, thereby securing the cards within the binder.

This arrangement allows the selective opening of the cards to review the interior of the cards without removing the same from the binder. Further, the binder can be closed (e.g., the front and rear covers are moved to a position wherein the two covers generally oppose one another) which provides for secure compact storage.

Therefore, according to one aspect of the invention, there is provided an apparatus for holding cards, comprising: a binder having a front portion, a back portion, and a spine portion; retaining member means for insertion between the interior spine of individual cards; and securing means, cooperatively connected to said spine, for securing said retaining member means to said spine, wherein cards are secured along the interior of the card spine between the front and back covers by said retaining member means.

These and various other advantages and features which characterize the invention are pointed out with particularity in the claims annexed hereto and forming a part hereon. However, for a better understanding of the invention, its advantages and objectives obtained by its use, reference should be had to the drawing which forms a further part hereof and to the accompanying descriptive matter, in which there is illustrated and described a preferred embodiment to the invention.

BRIEF DESCRIPTION OF THE DRAWING

Referring to the drawing, wherein like numerals represent like parts throughout the several views.

DETAILED DESCRIPTION OF THE PREFERRED EMBODIMENT

Figure 1:
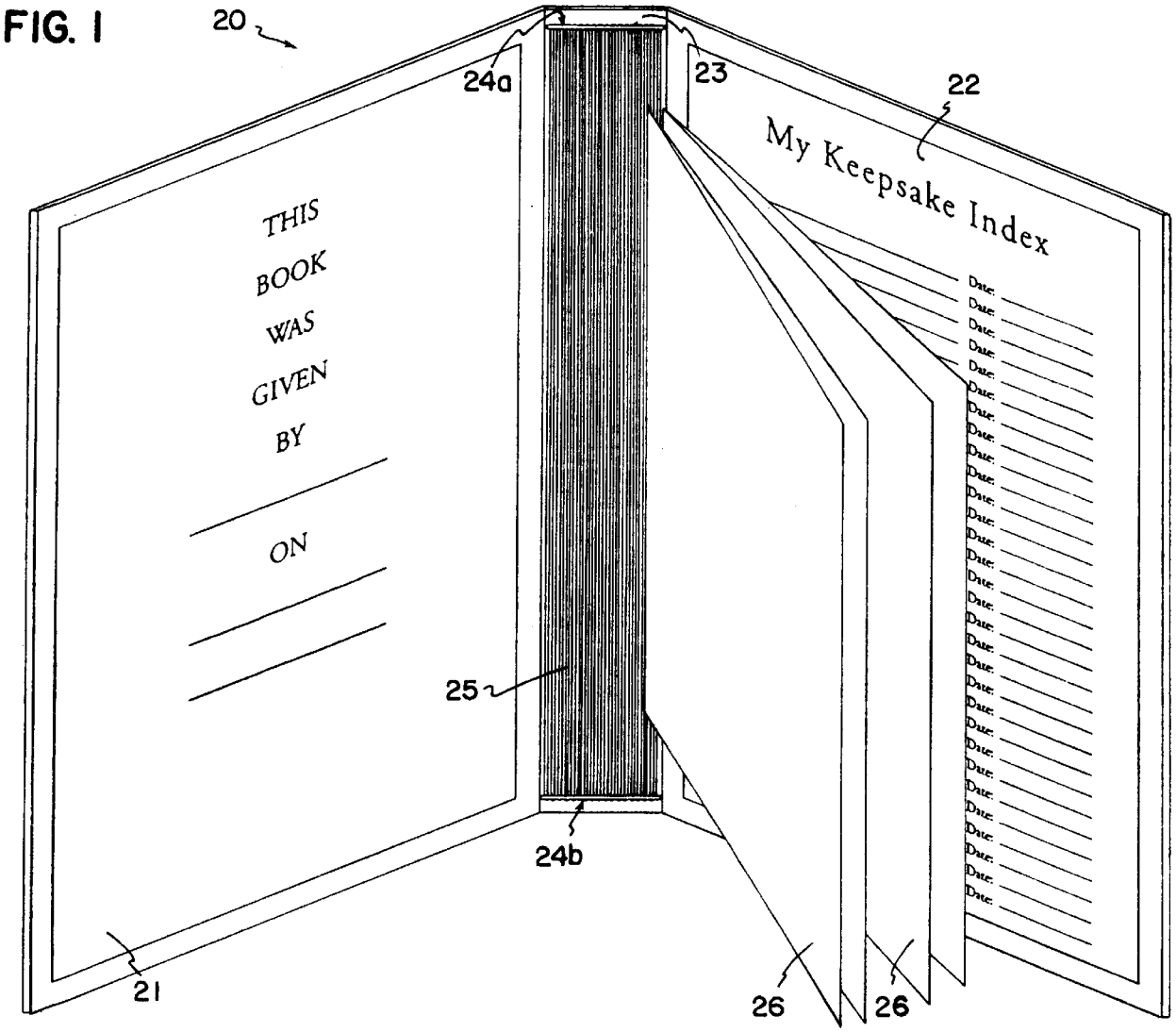
FIG. 1 is a front perspective view of a binder opened to illustrate several cards located therein.

Referring first to FIG. 1, there is illustrated an open album or binder designated generally at 20. Binder 20 has a front cover 21 and a rear cover 22 with a spine member 23 cooperative connecting the front cover 21 and rear cover 22. Located within the front cover 21 and rear cover 22 along the spine 23 are securing means 24*a* and 24*b* for holding a plurality of elongated retaining members 25 therebetween. The retaining members 25 are individually inserted into the interior of the cards (e.g., between the front and back covers of the cards 26) along the cards' spine. The greeting cards 26 are thereby retained within the front cover 21 and rear cover 22.

Still referring to FIG. 1, it will be appreciated that the front cover 21 and rear cover 22 provide locations for printed matter concerning the cards stored within the binder 20. The printed matter may comprise preprinted matter, space for user printed notes, or a combination thereof.

Figure 4:
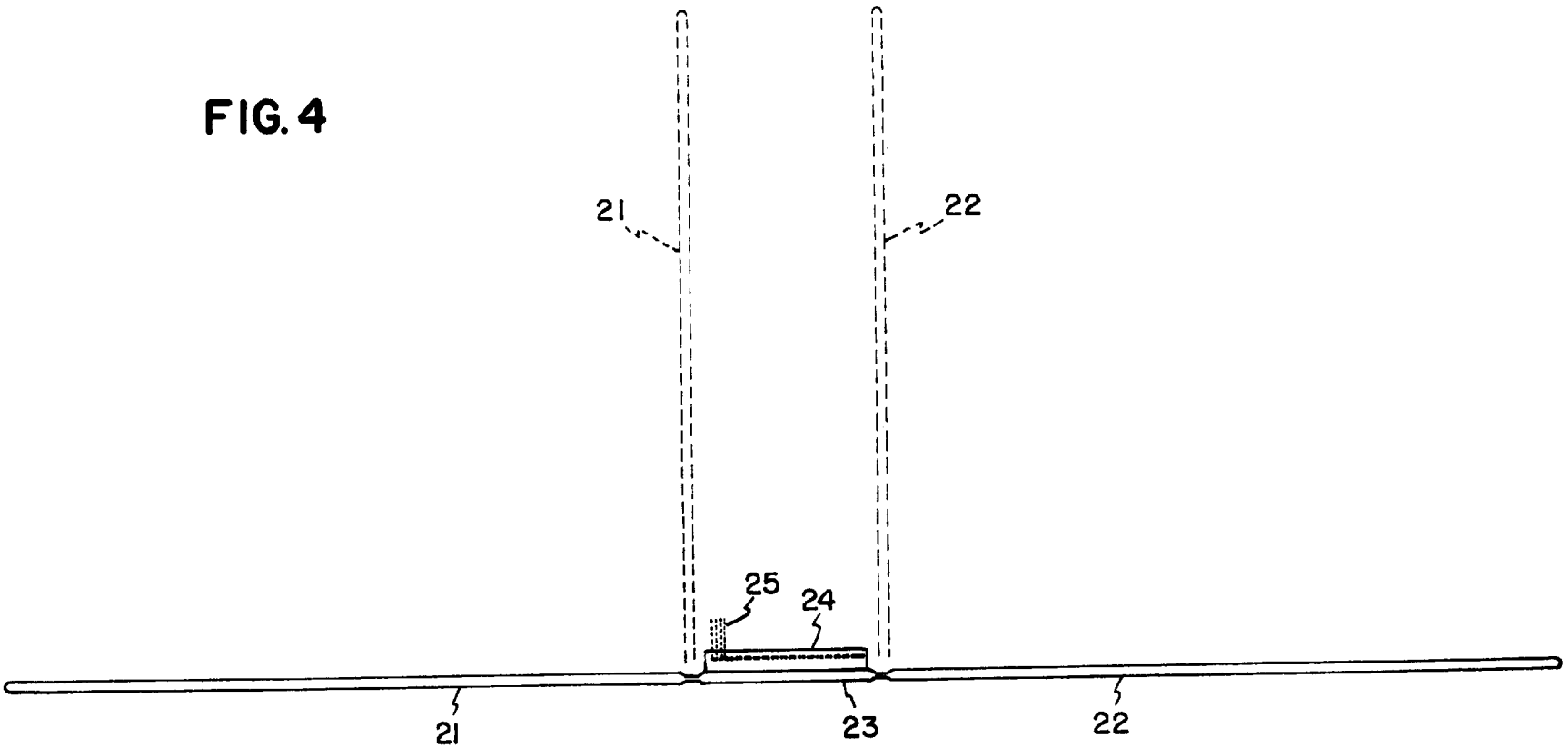
FIG. 4 is a side view of the securing means in a closed-position located within the binder.

The elongated retaining members 25 are generally oriented parallel to the longitudinal axis of the spine 23 and are also generally opposing and parallel with one another. This orientation properly retains the cards 26 within the binder 20 in both open and closed positions. The terms "open" and "closed" as used herein are used in the normal sense of describing the position of a book. FIG. 4 illustrates the binder 20 in an open position, with a closed position shown in phantom. Therefore, the binder's 20 open position may be defined as the position when the front cover 21 is extended away from the cards 26 (wherein the front cover 21 and rear cover 22 generally lie within the same mean plane or approach lying in the same mean plane). When the binder 20 is in a closed position, the front cover 21 and rear cover 22 define separate mean planes which are generally parallel with one another.

Figures 2, 3:
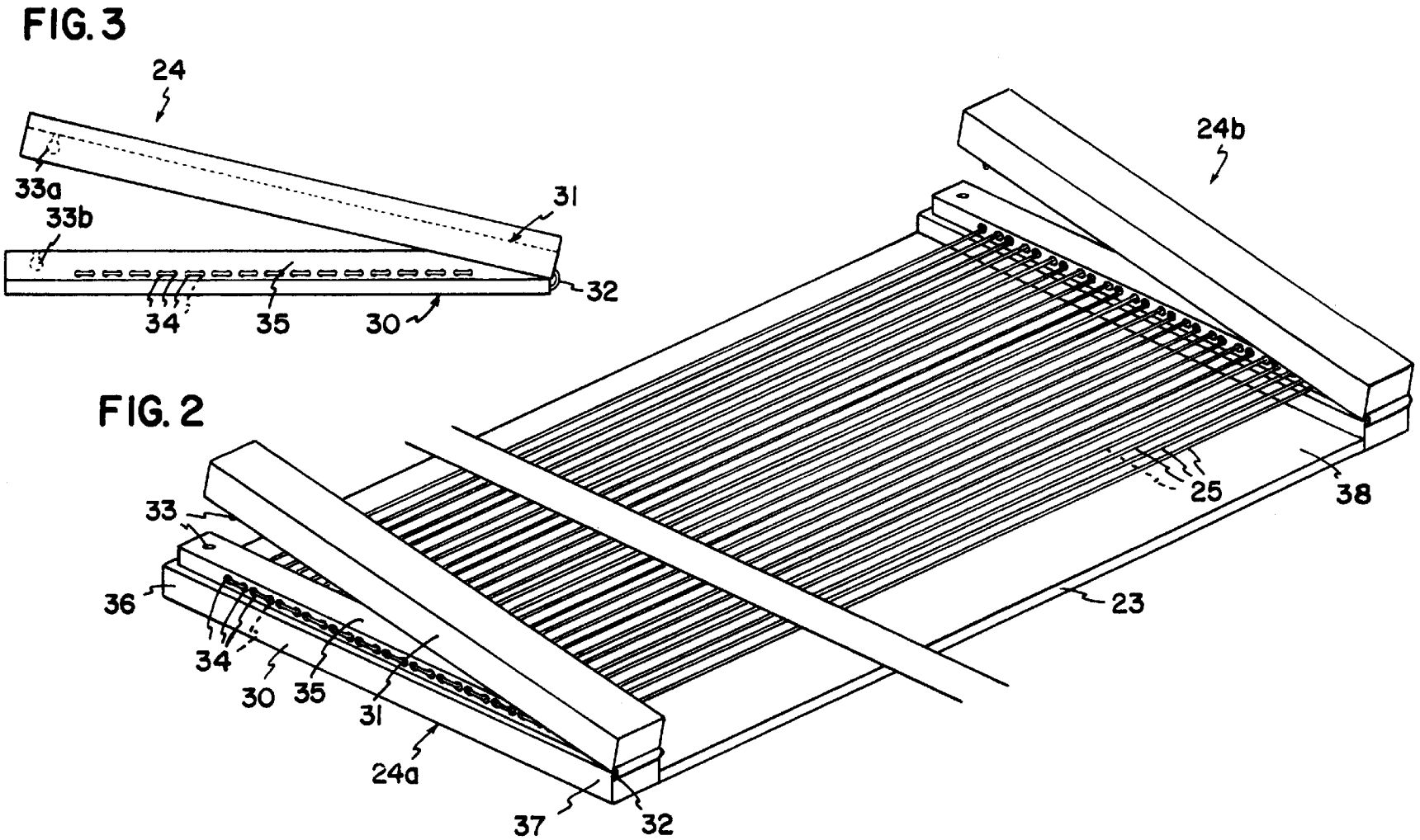
FIG. 2 is a perspective view of the elongate retaining members and securing means with portions broken away.
FIG. 3 is a side-elevation view of the locking member of the securing means of FIG. 2.

Turning now to FIGS. 2, 3, and 4, there is shown a first embodiment of the securing means 24*a* and 24*b* of the present invention. The securing means 24*a* and 24*b* are identical with one another in the preferred embodiment and so will be referred to for convenience herein as securing means 24 unless the context designates an individual securing means 24*a* or 24*b*. The securing means 24 includes a first member 30, a second member 31, a hinge 32, and a locking structure 33. Located between securing means 24*a* and 24*b* is a spacing member 38. Spacing member 38 may be integrally formed with the securing means 24, may be fixed to the spine 23, or may be comprised of spine 23.

The first member 30 includes a raised section 35 having a plurality of holes 34 formed therethrough. This allows for a "stringing" of the retaining member(s) 25 through the first member 30. The first member 30 also includes a first end 36 and a second end 37. Proximate first end 36 a female locking structure 33*b* is located. Proximate second end 37 a hinge 32 is located. Hinge 32 may be comprised of a "living hinge" or a structurally separate hinge device.

The second member 31 is hingedly attached to the first member 31 by hinge 32 and functions to lock-in the retaining members 25. Second member forms a hollow void for insertion over the raised or shoulder section 35. A male locking structure 33*a* is preferably integrally formed as a raised element of second member 31. The male locking structure 33*a* cooperatively engages the female void portion 33*b* to secure the second member 31 to the first member 30. It will be appreciated that the raised shoulder section 35 fits securely within the second member 31 when second member 31 is in its closed position.

In FIG. 4, the securing means 24 is shown with several of the retaining members 25. The securing means 24 is cooperatively attached to the spine 23 by means of glue, rivets, and/or other manners known in the art.

As noted above, the securing means 24*b* illustrated in FIG. 2 is identical to the securing means 24*a* described in connection with FIGS. 2, 3 and 4 above, and so will not be discussed in detail herein. Similarly, not all of the holes 34 within the raised shoulder section 35 of first member 30 are designated, nor are the each individual filament or retaining members 25.

The retaining members 25 may comprise a number of different types of materials. However, the function of the individual retaining members 25 is to secure a card 26 within the binder 20 by being spatially placed within the interior spine of a card 26. Because the retaining member is secured between the securing means 24*a* and 24*b*, the card 26 is held within the binder 20, but may be opened to review the interior contents of the card when the binder 20 is in its open position.

To perform this function, a number of different materials and structures may be utilized while still performing the functionality of the retaining member 25 means. For example, the retaining member means may be constructed of string, elastic, metal wire, metal strips (e.g, flat strips), metal rods, wood, or carbon, etc. In the preferred embodiment, an elastic band is used. With this structure, the same band may be strung back and forth several times between securing means 24*a* and 24*b*.

Figures 5, 6:
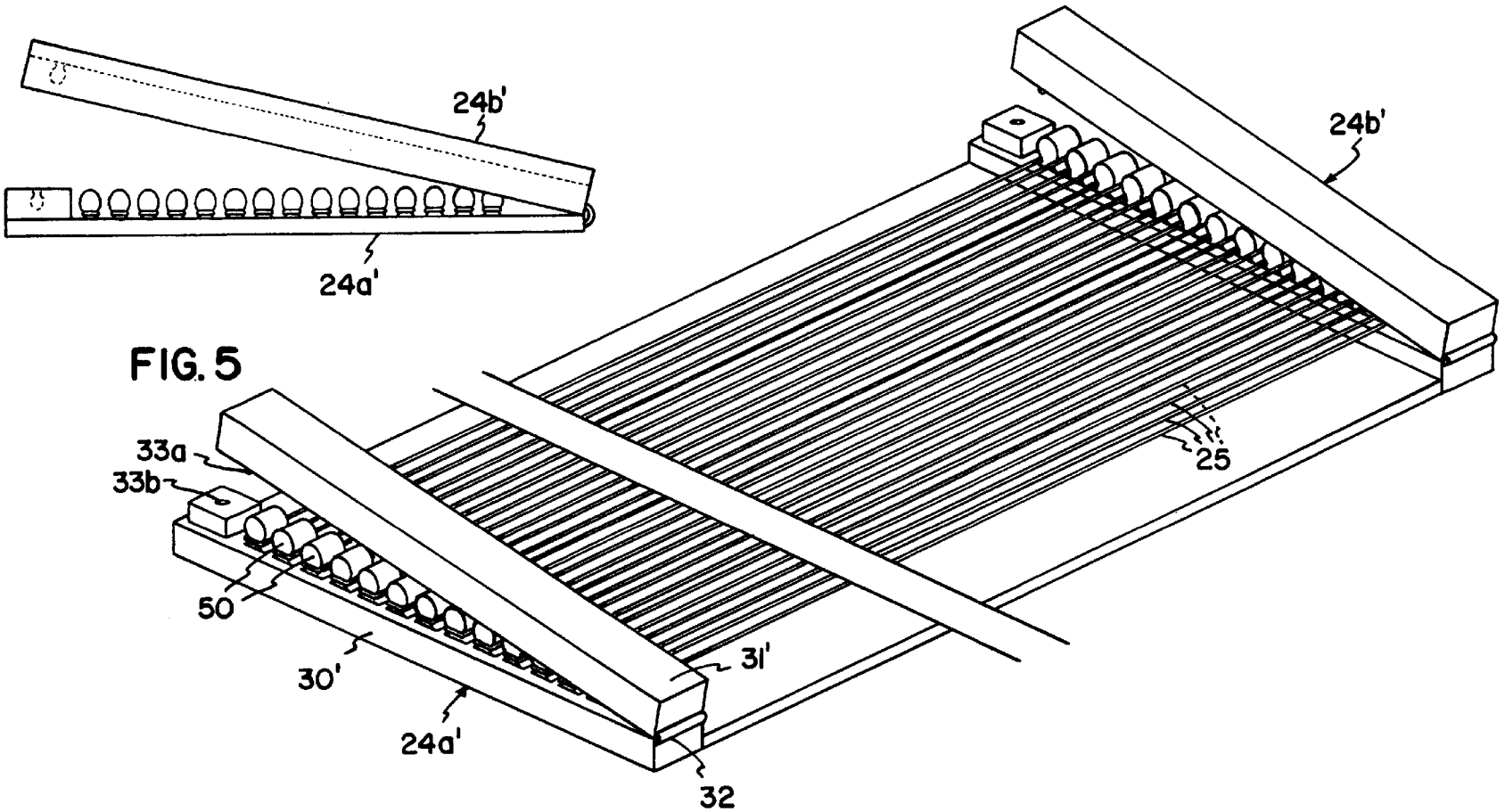
FIG. 5 is an alternative embodiment of the securing means of FIG. 2.
FIG. 6 is a front elevation view of the securing means of FIG. 5 in an open position.

Additionally, the securing means 24 for holding the retaining members 25 to the spine 23 of the binder 20 may be constructed in a number of manners. While a preferred manner has been described above in connection with FIGS. 2, 3, and 4, one alternative is illustrated in FIGS. 5 and 6. In the alternative embodiment, the securing means 24*a*' and 24*b*' again secure the retaining members 25 therebetween. However, rather than being strung through voids 34, the retaining members 25 are strung about individual raised members 50. The second member 31' may be constructed similarly to second member 31 and may be hingedly attached to first member 30'. In its closed position, second member 31' covers the top of the individual raised members 50 and fastens with the locking mechanism 33.

In the preferred and alternative embodiments, the securing means 24 may be constructed of a plastic injection molded piece or other durable material. The binder 24 is preferably constructed of a cardboard type material, and may be covered with a protective plastic or vinyl material.

It will be further appreciated that metal rods, strips, and fibers may be selectively inserted into the raised members 50 (not shown) in order to structurally perform retention of the cards 26 within the binder 20. Elastic is preferably used since it aids in the easy insertion of the cards within the device. However, such other members may be used and especially if the raised members 50 are arranged and configured to fit within depressions (not shown) in first member 30 (or 30') wherein the raised members might be selectively inserted and removed when the second member 31 (or 31') is in its open position.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. An apparatus for holding cards having an interior spine, comprising:

a) plurality of elongate members;

b) a cover having a front portion, a back portion, and a spine portion, wherein the spine portion includes means for securing the elongate members, wherein said securing means include:

i) a pair of spaced apart first members, each having a raised section with a plurality of holes formed therethrough; and ii) a pair of spaced apart second members, each cooperatively connected to one of said first members, each of said second members having a void formed therein which is arranged and configured to engage and encompass one of said raised sections; and c) wherein said elongate members are adapted to secure the cards along the interior spine of the card between the front and back portions of said cover.

2. The apparatus of claim 1, wherein said elongate members are constructed of elastic.

3. The apparatus of claim 1, wherein each of said first and second members are hingedly attached to each other.

4. The apparatus of claim 3, wherein said elongate members are comprised of a single elastic filament which is threadably inserted through said plurality of holes in said first members.

5. The apparatus of claim 4, wherein said first and second members include a locking structure for selectively fastening said first member to said second member, wherein said elastic filament is locked into said securing means.

6. An apparatus for holding cards having an interior spine, comprising:

a) a binder having a front portion, a back portion, and a binder spine portion;

b) retaining means for insertion between an interior spine of individual cards; and c) securing means, cooperatively connected to said binder spine portion, for securing said retaining means to said binder spine portion, wherein said retaining means are adapted to secure the cards along the interior spine of the card between said front and back portions of said binder, and wherein said securing means include:

i) a pair of spaced apart opposing first members, each having opposing raised sections with said retaining means located between said opposing raised sections; and ii) a pair of spaced apart second members, each cooperatively connected to one of said first members, each of said second members having a void formed therein which is arranged and configured to engage and encompass one of said raised sections.

* * * * *